US010256039B2

(12) United States Patent
Kim et al.

(10) Patent No.: US 10,256,039 B2
(45) Date of Patent: Apr. 9, 2019

(54) COIL ELECTRONIC COMPONENT AND METHOD FOR MANUFACTURING THE SAME

(71) Applicant: SAMSUNG ELECTRO-MECHANICS CO., LTD., Suwon-Si, Gyeonggi-Do (KR)

(72) Inventors: You Na Kim, Suwon-Si (KR); Moon Soo Park, Suwon-Si (KR); Min Hee Kim, Suwon-Si (KR); Jong Ho Lee, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 16 days.

(21) Appl. No.: 14/988,924

(22) Filed: Jan. 6, 2016

(65) Prior Publication Data

US 2016/0268040 A1 Sep. 15, 2016

(30) Foreign Application Priority Data

Mar. 9, 2015 (KR) ..... 10-2015-0032374

(51) Int. Cl.

| | |
|---|---|
| ***H01F 27/02*** | (2006.01) |
| ***H01F 41/04*** | (2006.01) |
| ***H01F 17/00*** | (2006.01) |
| ***H01F 27/255*** | (2006.01) |

(52) U.S. Cl.

CPC ..... *H01F 41/041* (2013.01); *H01F 17/0013* (2013.01); *H01F 27/255* (2013.01)

(58) Field of Classification Search

CPC ... H01F 41/043; H01F 17/0013; H01F 27/255
USPC ..... 336/90, 200, 232, 198, 206, 219
See application file for complete search history.

(56) References Cited

U.S. PATENT DOCUMENTS

| | | | | |
|---|---|---|---|---|
| 6,392,525 | B1 * | 5/2002 | Kato | H01F 3/08 336/200 |
| 2009/0108979 | A1 * | 4/2009 | Kosugi | H01F 27/326 336/208 |
| 2009/0295526 | A1 * | 12/2009 | Mikami | C01G 49/009 336/196 |
| 2013/0222101 | A1 * | 8/2013 | Ito | H01F 17/04 336/83 |
| 2013/0249662 | A1 * | 9/2013 | Tonoyama | H01F 27/255 336/200 |
| 2016/0049234 | A1 * | 2/2016 | Kawashima | H01F 17/0013 336/200 |

FOREIGN PATENT DOCUMENTS

| | | |
|---|---|---|
| JP | 2004146655 | * 10/2002 |
| JP | 2006-278479 A | 10/2006 |
| JP | 2006-278909 A | 10/2006 |
| JP | 2014-013815 A | 1/2014 |

* cited by examiner

*Primary Examiner* — Elvin G Enad
*Assistant Examiner* — Kazi S Hossain
(74) *Attorney, Agent, or Firm* — Morgan Lewis & Bockius LLP

(57) ABSTRACT

A coil electronic component includes: a coil part; an insulating layer covering the coil part; a magnetic body enclosing the coil part covered by the insulating layer; and an adhesive layer disposed between the insulating layer and the magnetic body to prevent chipping of the magnetic body.

5 Claims, 6 Drawing Sheets

COIL ELECTRONIC COMPONENT AND METHOD FOR MANUFACTURING THE SAME

CROSS-REFERENCE TO RELATED APPLICATION

This application claims the benefit of priority to Korean Patent Application No. 10-2015-0032374 filed on Mar. 9, 2015, with the Korean Intellectual Property Office, the disclosure of which is incorporated herein by reference.

BACKGROUND

The present disclosure relates to a coil electronic component and a method for manufacturing the same.

An inductor, a coil electronic component, is a representative passive element configuring an electronic circuit together with a resistor and a capacitor to remove noise.

The inductor may be manufactured by forming a coil part, hardening a magnetic powder-resin composite in which a magnetic powder and a resin are mixed with each other to form a magnetic body enclosing the coil part, and then forming external electrodes on outer surfaces of the magnetic body.

SUMMARY

An aspect of the present disclosure may provide a coil electronic component capable of reducing chipping, and a method for manufacturing the same.

According to an aspect of the present disclosure, a coil electronic component may include: a coil part; an insulating layer covering the coil part; a magnetic body enclosing the coil part covered by the insulating layer; and an adhesive layer disposed between the insulating layer and the magnetic body to prevent chipping of the magnetic body.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
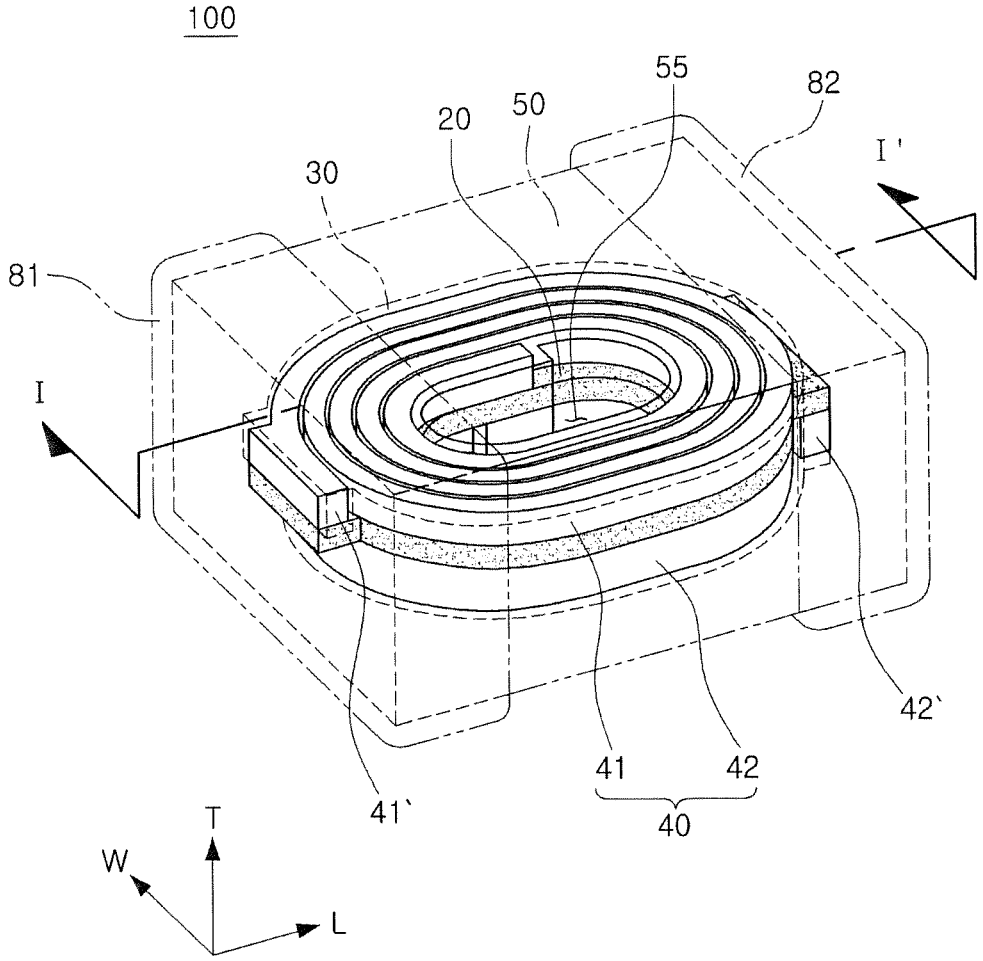
FIG. 1 is a perspective view illustrating a coil electronic component including a coil part according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Coil Electronic Component

Hereinafter, a coil electronic component according to an exemplary embodiment, particularly, a thin film type inductor, will be described. However, the present disclosure is not necessarily limited thereto.

FIG. 1 is a perspective view illustrating a coil electronic component including a coil part according to an exemplary embodiment.

Referring to FIG. 1, as an example of a coil electronic component, a thin film type power inductor used in a power line of a power supply circuit is disclosed.

A coil electronic component 100, according to an exemplary embodiment, may include a coil part 40, an insulating layer 30 covering the coil part 40, a magnetic body 50 enclosing the coil part 40 covered by the insulating layer 30, and first and second external electrodes 81 and 82 disposed on an outer surface of the magnetic body 50 and electrically connected to the coil part 40.

In the coil electronic component according to an exemplary embodiment, a "length direction" refers to an "L" direction of FIG. 1, a "width direction" refers to a "W" direction of FIG. 1, and a "thickness direction" refers to a "T" direction of FIG. 1.

The coil part 40 may be formed by connecting a first coil conductor 41 formed on one surface of a substrate 20 to a second coil conductor 42 formed on the other surface of the substrate 20 opposing one surface of the substrate 20.

The first and second coil conductors 41 and 42 may each have the form of a planar coil formed on the same plane of the substrate 20.

The first and second coil conductors 41 and 42 may be formed in a spiral shape.

The first and second coil conductors 41 and 42 may be formed by performing electroplating on the substrate 20, but are not necessarily limited thereto.

The first and second coil conductors 41 and 42 may be formed of a metal having excellent electrical conductivity, such as silver (Ag), palladium (Pd), aluminum (Al), nickel (Ni), titanium (Ti), gold (Au), copper (Cu), platinum (Pt), or an alloy thereof.

The substrate 20 may be, for example, a polypropylene glycol (PPG) substrate, a ferrite substrate, or a metal based soft magnetic substrate.

A central portion of the substrate 20 may be removed to form a through hole, and the through hole may be filled with a magnetic material to form a core part 55 inwardly of the coil part 40.

As the core part 55 is formed of the magnetic material, an area of the magnetic body through which magnetic flux passes may be increased, thereby improving inductance L.

However, the substrate 20 is not necessarily included, and the coil part may also be formed of a metal wire without including the substrate.

The first and second coil conductors 41 and 42 may be coated with the insulating layer 30 so as not to directly be in contact with the magnetic material forming the magnetic body 50, thereby preventing short circuits.

The insulating layer 30 may include, for example, a polymer material such as an epoxy resin, a polyimide resin, or the like, a photo resist (PR), or a metal oxide, but is not necessarily limited thereto. For example, any material may be used as long as it covers the first and second coil conductors 41 and 42 to prevent short circuits.

The magnetic body 50 enclosing the coil part 40 may include any material as long as the material is a magnetic material that exhibits magnetic properties. For example, the magnetic body 50 may include ferrite or magnetic metal powder.

Meanwhile, in the coil electronic component 100, according to the exemplary embodiment, an adhesive layer (not illustrated in FIG. 1) preventing chipping of the magnetic body may be formed between the insulating layer 30 and the magnetic body 50. A detailed description of the adhesive layer according to the exemplary embodiment will be provided below.

One end portion of the first coil conductor 41 may be extended to form a first lead portion 41', and the first lead portion 41' may be exposed to one end surface of the magnetic body 50 in a length L direction of the magnetic body 50. One end portion of the second coil conductor 42 may be extended to form a second lead portion 42', and the second lead portion 42' may be exposed to the other end surface of the magnetic body 50 in the length L direction of the magnetic body 50.

However, the first and second lead portions 41' and 42' are not necessarily limited thereto. For example, the first and second lead portions 41' and 42' may be exposed to at least one surface of the magnetic body 50.

The first and second external electrodes 81 and 82 may be formed on at least one outer surface of the magnetic body 50 so as to be connected to the first and second lead portions 41' and 42', respectively.

The first and second external electrodes 81 and 82 may be formed of a metal having excellent electrical conductivity, such as copper (Cu), silver (Ag), nickel (Ni), and tin (Sn), or an alloy thereof.

Figure 2:
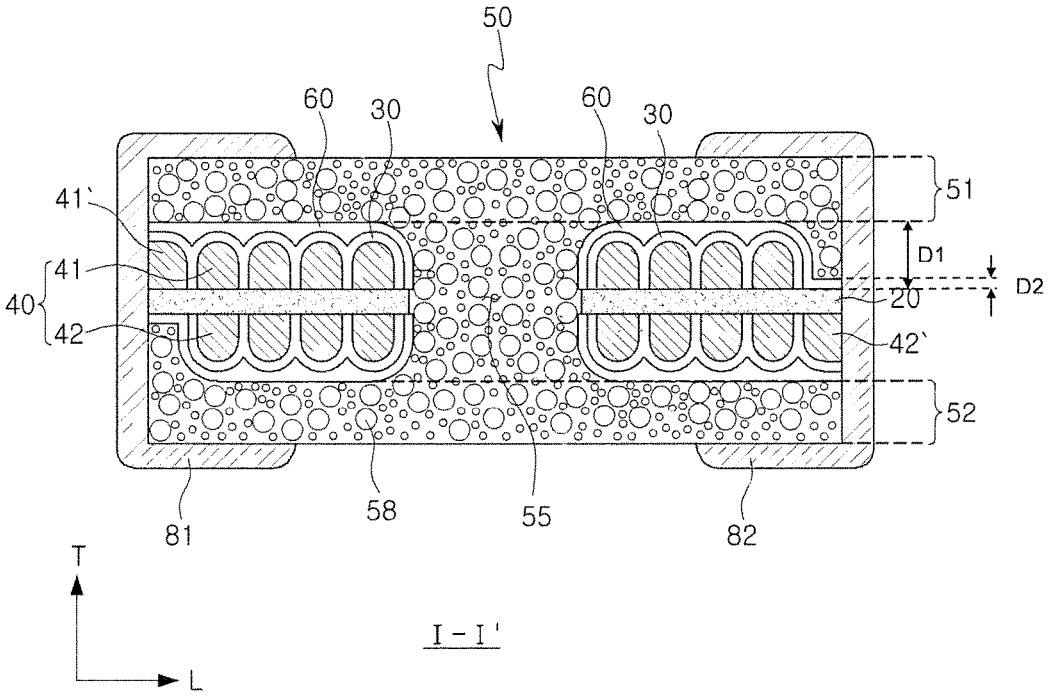
FIG. 2 is a cross-sectional view taken along line I-I' of FIG. 1.

FIG. 2 is a cross-sectional view taken along line I-I' of FIG. 1.

Referring to FIG. 2, the magnetic body 50 of the coil electronic component 100, according to the exemplary embodiment, may include a magnetic metal powder 58.

The magnetic metal powder 58 may be a crystalline or amorphous metal including one or more selected from the group consisting of iron (Fe), silicon (Si), boron (B), chromium (Cr), aluminum (Al), copper (Cu), niobium (Nb), and nickel (Ni).

For example, the magnetic metal powder 58 may include an Fe—Si—Cr based amorphous metal, but is not necessarily limited thereto.

The magnetic metal powder 58 may have a particle diameter of 0.1 μm to 30 μm, and two or more kinds of magnetic metal powders having different average particle diameters may be mixed with each other.

By mixing the two or more kinds of magnetic metal powders having different average particle diameters, a filling rate is improved, and thus high permeability may be secured and deterioration resulting from core loss at high frequency and high current may be prevented.

The magnetic metal powder 58 may be dispersed in a thermosetting resin.

The thermosetting resin may be, for example, an epoxy resin, polyimide, or the like.

A volume of the magnetic metal powder 58 in the magnetic body 50 may be equal to 60% or more.

By increasing the filling rate of the magnetic metal powder 58 so that the volume ratio is equal to 60% or more, high permeability may be secured.

On the other hand, as the filling rate of the magnetic metal powder 58 is increased, the content of the thermosetting resin forming the magnetic body 50 may be decreased. Further, as the coil electronic component is gradually miniaturized, thicknesses of cover parts 51 and 52 formed on the coil part 40 are reduced, and thus chipping may occur in thin portions of the cover parts.

In order to mass-produce the coil electronic component 100, after a multilayer body in which a plurality of coil parts are formed is manufactured, cutting and grinding operations may be performed to form individual coil electronic components. In this case, since the cover parts 51 and 52 are formed to be gradually thin and adhesion is insufficient due to the reduced content of the thermosetting resin, a chipping defect in which the cover parts 51 and 52 are cracked or peeled off during the cutting and grinding operations may occur.

Thus, in the coil electronic component 100, according to the exemplary embodiment, an adhesive layer 60 preventing the chipping of the magnetic body may be formed between the insulating layer 30 and the magnetic body 50. As a result, even when the cutting and grinding operations are performed, the occurrence of chipping in the magnetic body 50, particularly, in the thin cover parts 51 and 52, may be reduced.

The adhesive layer 60, according to the exemplary embodiment, may have adhesion greater than that of the magnetic body 50.

Thus, as compared to a case in which the magnetic body 50 is directly formed on the insulating layer 30 covering the coil part 40, when the adhesive layer 60 is formed between the insulating layer 30 and the magnetic body 50 as in the exemplary embodiment, adhesion between the insulating layer 30 covering the coil part 40 and the magnetic body 50 may be improved, thereby reducing chipping.

For a material forming the adhesive layer 60, any material may be used as long as the material improves adhesion between the insulating layer 30 and the magnetic layer 50 to prevent chipping of the magnetic body 50 and does not disturb characteristics of the coil electronic component 100.

Although FIG. 2 illustrates the adhesive layer 60 in a shape covering the insulating layer 30, the shape of the adhesive layer 60 is not necessarily limited thereto. For example, the adhesive layer 60 may be formed in a portion between the insulating layer 30 and the magnetic body 50 and may also be partially formed in the core part 55.

Method for Manufacturing Coil Electronic Component

Figure 3:
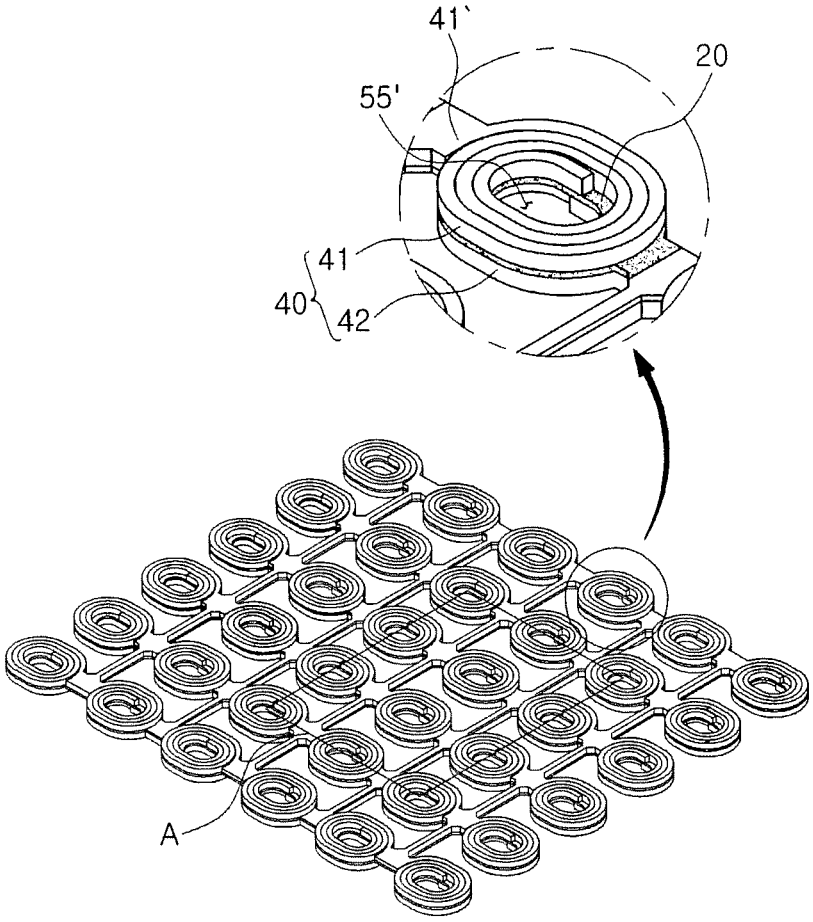
FIG. 3 is a view illustrating the formation of coil parts according to an exemplary embodiment in the present disclosure.

FIG. 3 is a view illustrating the formation of coil parts according to an exemplary embodiment in the present disclosure.

Referring to FIG. 3, first, a plurality of coil parts 40 may be formed.

The first and second coil conductors 41 and 42, and a via (not illustrated) connecting the first and second coil conductors 41 and 42 may be formed by forming a via hole (not illustrated) in the substrate 20, forming a plating resist having an opening on the substrate 20, and then filling the via hole and the opening with a conductive metal by plating.

The first and second coil conductors 41 and 42 and the via may be formed of a conductive metal having excellent electrical conductivity, such as silver (Ag), palladium (Pd), aluminum (Al), nickel (Ni), titanium (Ti), gold (Au), copper (Cu), platinum (Pt), or an alloy thereof.

However, a method of forming the coil parts 40 is not necessarily limited to the above-mentioned plating method. For example, the coil parts may be formed of a metal wire and may be formed in any form as long as it may generate magnetic flux by applied current.

The substrate 20 may be, for example, a polypropylene glycol (PPG) substrate, a ferrite substrate, or a metal based soft magnetic substrate.

A central portion of the substrate 20 in which the first and second coil conductors 41 and 42 are not formed is removed to form a core part hole 55'.

The removal of the substrate 20 may be performed by mechanical drilling, laser drilling, sandblasting, punching, or the like.

Figure 4A:
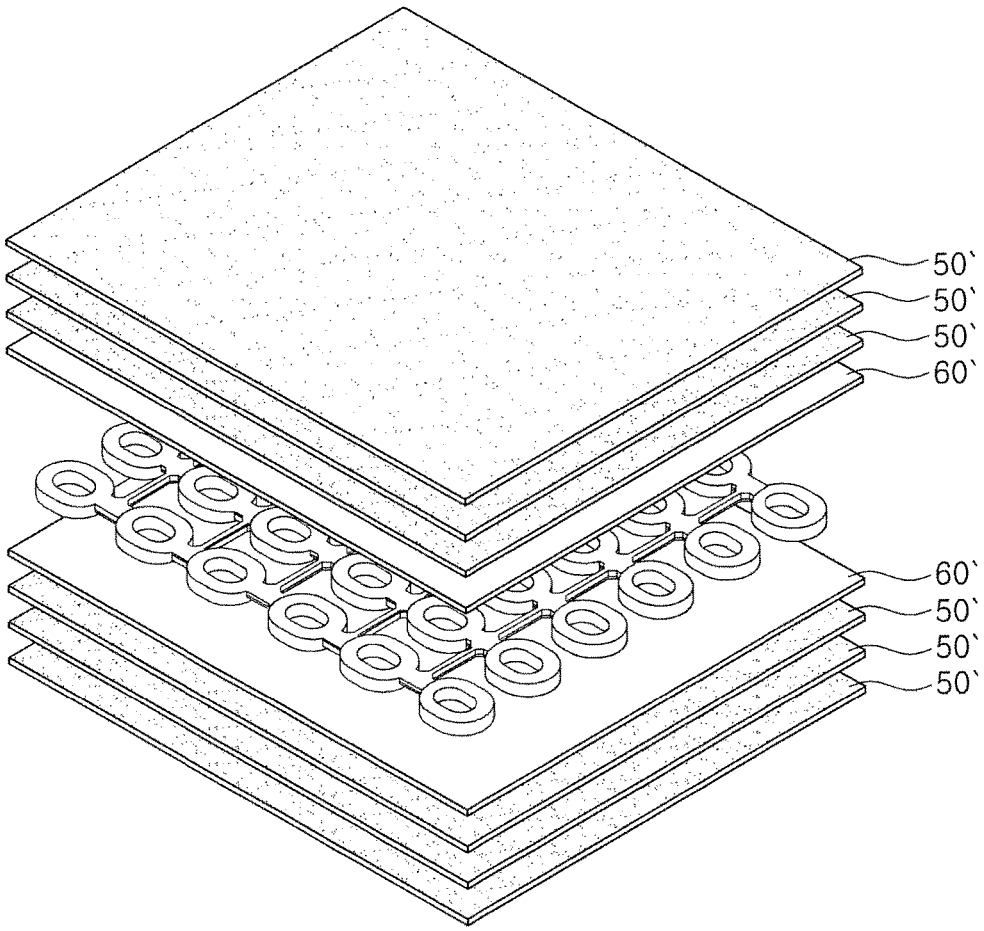
FIGS. 4A and 4B are a perspective view and a cross-sectional view illustrating the stacking of adhesive sheets and magnetic sheets according to an exemplary embodiment in the present disclosure.
Figure 4B:
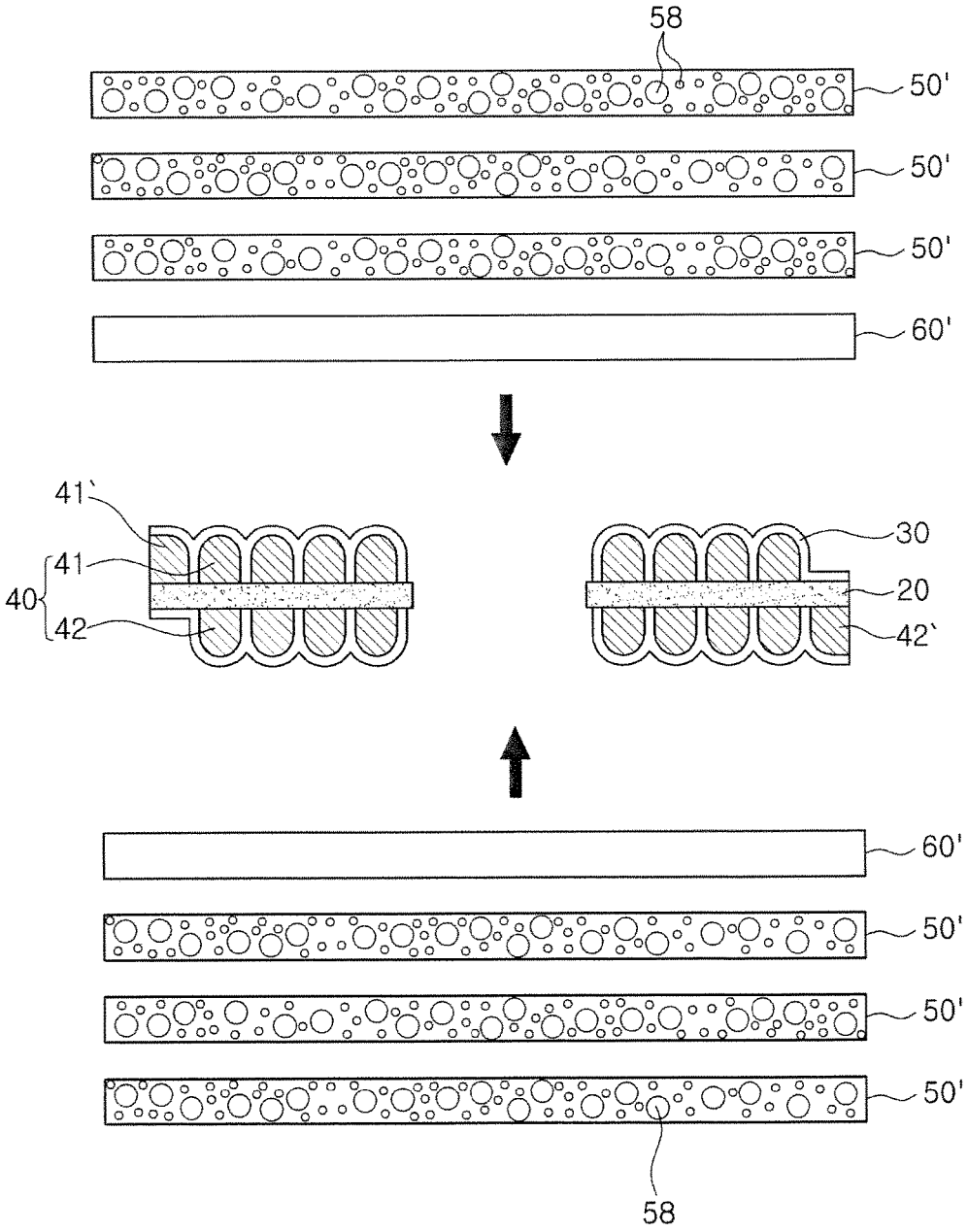

FIGS. 4A and 4B are each a perspective view and a cross-sectional view illustrating the stacking of adhesive sheets and magnetic sheets according to an exemplary embodiment.

Referring to FIGS. 4A and 4B, the insulating layer 30 covering the first and second coil conductors 41 and 42 may be formed on the first and second coil conductors 41 and 42.

The insulating layer 30 may include, for example, a polymer material such as an epoxy resin or a polyimide resin, a photo resist (PR), or a metal oxide, but is not necessarily limited thereto. For example, any material may be used as long as it covers the first and second coil conductors 41 and 42 to prevent short circuits.

The insulating layer 30 may be formed by a screen printing method, an exposure development of a photoresist (PR) a spraying method, oxidation by chemical etching of the coil conductors, or the like.

Meanwhile, the insulating layer 30 may be formed by a chemical vapor deposition (CVD) or a dipping method using a polymer coating solution having low viscosity, and the insulating layer 30 formed as described above may be coated to be thin in accordance with shapes of surfaces of the first and second coil conductors 41 and 42.

Next, adhesive sheets 60' may be formed on upper and lower portions of the coil parts 40 covered by the insulating layer 30.

The adhesive sheets 60' may have adhesion greater than that of magnetic sheets 50' to be stacked later.

Thus, as compared to a case in which the magnetic sheets 50' are directly formed on the insulating layer 30 covering the coil parts 40, when the adhesive sheets 60' are formed between the insulating layer 30 and the magnetic sheets 50' as in the exemplary embodiment, adhesion between the insulating layer 30 covering the coil part 40 and the magnetic body 50 (which is formed by stacking, compressing, and curing the magnetic sheets 50') may be improved, thereby reducing chipping.

For a material forming the adhesive sheets 60', any material may be used as long as the material improves adhesion between the insulating layer 30 and the magnetic layer 50 to prevent chipping of the magnetic body 50 and does not disturb characteristics of the coil electronic component 100.

Next, a multilayer body may be formed by stacking the magnetic sheets 50' on the adhesive sheets 60' and compressing and curing the same.

The magnetic sheets 50' may be formed by preparing slurry by mixing the metal magnetic powder 58 with an organic material such as a thermosetting resin, a binder, a solvent, and the like, applying the slurry on carrier films at a thickness of several tens of μm by a doctor blade method, and then drying the applied slurry.

The magnetic sheets 50' may be prepared in a form in which the metal magnetic powder 58 is dispersed in the thermosetting resin such as an epoxy resin, polyimide, or the like.

The multilayer body may be formed by stacking, compressing, and curing the magnetic sheets 50'. In this case, the core part hole 55' may be filled with the magnetic sheets 50' to form the core part 55.

Figure 5:
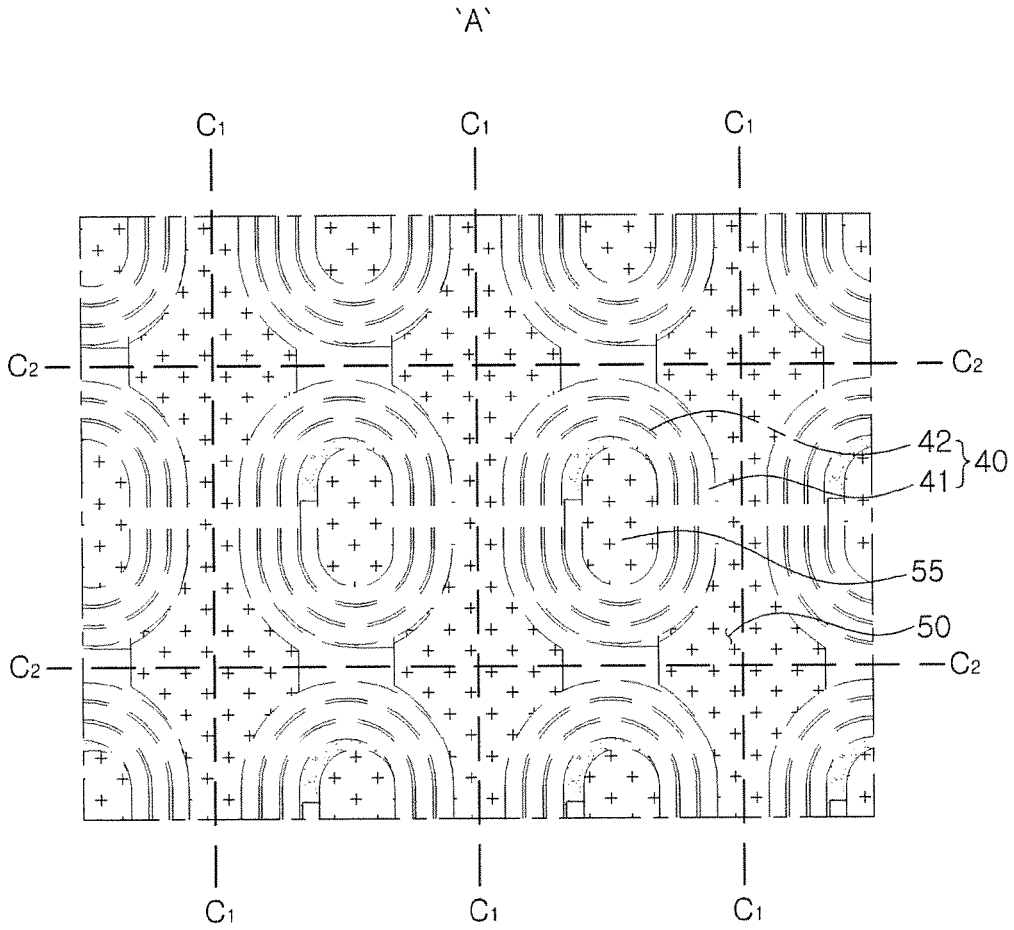
FIG. 5 is a view illustrating the cutting of a multilayer body according to an exemplary embodiment in the present disclosure.

FIG. 5 is a view illustrating the cutting of a multilayer body according to an exemplary embodiment.

Referring to FIG. 5, individual coil electronic components 100 each including the magnetic body 50 enclosing the coil part 40 may be formed by cutting the multilayer body along cutting lines C1-C1 and C2-C2.

According to the exemplary embodiment, in order to mass-produce the coil electronic component 100, after the multilayer body in which a plurality of coil parts are formed is prepared, cutting and grinding operations may be performed to form individual coil electronic components 100.

In this case, since the cover parts 51 and 52 are formed to be thin on the upper and lower portions of the coil parts 40, while the coil electronic component is gradually miniaturized, and the filling rate of the metal magnetic powder 58 is increased such that the content of the thermosetting resin is decreased in order to implement high permeability of the magnetic body 50, adhesion may be insufficient, and thus chipping in which the thin cover parts 51 and 52 are cracked or peeled off during the cutting and grinding operations may occur.

As a result, according to the exemplary embodiment, the adhesive sheets 60' are formed on the upper and lower portions of the coil parts 40 covered by the insulating layer 30, and the magnetic sheets 50' may be then stacked on the magnetic sheets 60', and thus adhesion between the insulating layer 30 and the magnetic body 50 (which is formed by stacking, compressing, and curing the magnetic sheets 50') may be improved to prevent chipping of the magnetic body 50, particularly of the thin cover parts 51 and 52, which may be reduced even during the cutting and grinding operations.

Next, the coil electronic component 100 may be manufactured by forming the first and second external electrodes 81 and 82 on the outer surfaces of the cut magnetic body 50 so as to be connected to the coil parts 40.

Except for the above-mentioned description, a description of features overlapping with those of the coil electronic component according to the previous exemplary embodiment will be omitted.

As set forth above, according to exemplary embodiments, chipping of the magnetic body may be reduced.

While exemplary embodiments have been shown and described above, it will be apparent to those skilled in the art that modifications and variations could be made without departing from the scope of the present invention as defined by the appended claims.

What is claimed is:

1. A coil electronic component comprising:

a substrate, including a through hole in a central portion of the substrate;

a coil part on the substrate;

an insulating layer covering the coil part;

an adhesive layer covering the insulating layer a magnetic body enclosing the coil part, the insulating layer, and the adhesive layer, and in the through hole of the substrate, comprising a magnetic metal powder and a thermosetting resin, wherein a distance between an upper surface of the adhesive layer disposed on the coil part and the substrate is greater than a distance between an upper surface of the adhesive layer not disposed on the coil part and the substrate.

2. The coil electronic component of claim 1, wherein the adhesive layer has adhesion greater than that of the magnetic body.

3. The coil electronic component of claim 1, wherein a volume of the magnetic metal powder in the magnetic body is equal to 60% or more.

4. The coil electronic component of claim 1, wherein the coil part includes a first coil conductor disposed on one surface of the substrate and a second coil conductor disposed on the other surface of the substrate.

5. The coil electronic component of claim 4, wherein the first and second coil conductors are formed by plating.

* * * * *